US006308906B1

(12) United States Patent
Pyra et al.

(10) Patent No.: US 6,308,906 B1
(45) Date of Patent: Oct. 30, 2001

(54) METHOD OF WINDING A CONTINUOUSLY ADVANCING YARN

(75) Inventors: Michael Pyra, Brüggen; Reinhard Lieber, Sporckhövel, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/571,098

(22) Filed: May 15, 2000

(30) Foreign Application Priority Data

May 14, 1999 (DE) ..... 199 22 393
Aug. 2, 1999 (DE) ..... 199 36 349

(51) Int. Cl.[7] ..... B65H 67/04; B65H 54/28

(52) U.S. Cl. ..... 242/476.3; 242/476.4; 242/477.9

(58) Field of Search ..... 242/476.2, 476.3, 242/476.4, 477.9

(56) References Cited

U.S. PATENT DOCUMENTS 4,948,057 8/1990 Greis .

FOREIGN PATENT DOCUMENTS 0 311 827 A2 4/1989 (EP) .

*Primary Examiner*—Michael R. Mansen
(74) *Attorney, Agent, or Firm*—Alston & Bird LLP

(57) ABSTRACT

A method for winding a continuously advancing yarn to a cross-wound package on a rotating tube wherein the yarn is deposited on the tube during the winding of the package within a winding range. Directly before the winding cycle, a yarn reserve wind forming a trailing yarn end of the package is deposited outside of the winding range. In this process, the yarn is guided by a yarn guide that is movable substantially parallel to the tube surface. In accordance with the invention, the yarn guide is reciprocated at different guiding speeds for purposes of securing the trailing yarn end on the circumference of the tube with at least some yarn winds of the yarn reserve wind.

12 Claims, 5 Drawing Sheets

METHOD OF WINDING A CONTINUOUSLY ADVANCING YARN

BACKGROUND OF THE INVENTION

The present invention relates to a method of winding a continuously advancing yarn to a cross wound package, and so as to form a yarn reserve wind at the beginning of the winding cycle.

EP 0 311 827 and corresponding U.S. Pat. No. 4,948,057 disclose a winding method wherein an advancing yarn is wound on a driven tube which is clamped between two centering plates. The centering plates are rotatably supported. The tube lies against a drive roll, and is driven by same. After the tube has reached a predetermined winding speed, the yarn is caught and cut by a catching groove, which is arranged in the circumferential region of one centering plate. The loose yarn end is taken in by a suction device. After initial layers of the yarn have been wound on the tube laterally next to the winding range to a so-called yarn reserve wind, winding of the package starts. For catching and winding initial layers, the yarn is guided by a movable yarn guide.

Takeup devices of the described type are used, for example, in texturing machines for winding a textured yarn to a package. To this end, the continuously advancing yarn is caught before the winding start, cut, and deposited on the tube with a yarn reserve wind next to the actual winding range. In this connection, the yarn reserve wind forms the trailing yarn end of the package, which is knotted in a further processing operation to the leading yarn end of a second package. This makes it necessary to secure the yarn end on the tube surface in an easily recognizable and reliable manner. In the known method, the yarn is clamped at the front end of the package between the centering plate and the tube, so that after the package doff, the yarn end is no longer clamped. After completing the package and after doffing the package, there arises the problem that the yarn end disengages from the yarn reserve wind, and leads in the extreme case to a complete unwinding of the yarn reserve.

It is therefore an object of the invention to further develop a method of the initially described type in such a manner that the yarn end is reliably secured on the circumference of the tube, even when the packages are removed.

A further object of the invention involves depositing the yarn end on the circumference of the package with clear identification marks.

SUMMARY OF THE INVENTION

The above and other objects and advantages are achieved by the provision of a method of winding a continuously advancing yarn which comprises initially forming a yarn reserve on the tube outside the winding range by guiding the advancing yarn with a yarn guide which is moveable substantially parallel to the tube. The yarn guide is moved by a controllable drive such that the yarn guide is reciprocated to secure the trailing yarn end on the circumference of the tube with at least some of the winds of the yarn reserve. The advancing yarn is then wound onto the tube within the winding range to form a cross wound package.

The invention makes it possible to influence the winds in their slope, as well as in their direction of deposit. To this end, the yarn guide may be moved to reciprocate at different guiding speeds, which renders it possible to influence the slope of the yarn wind on the tube surface. In this connection, the higher the guiding speed, the steeper is the slope of the wind. The direction of the yarn deposit is dependent on the direction of movement of the yarn guide. Thus, at each change in direction of the yarn guide, the reciprocating movement causes a change in the direction of deposit of the winds on the tube surface.

When winding dye yarn packages (subsequently dyed packages), it is often necessary to wind a waste wind within the winding range, before winding a yarn reserve wind. Subsequent thereto, the yarn reserve is produced outside of the winding range, so as to start thereafter the actual winding cycle. These sequences of movements produce on the tube surface a plurality of wind transitions between the yarn reserve wind and the package. Since the leading yarn end with the waste wind is unsuitable for further processing, the trailing yarn end of the package is formed by the yarn reserve wind that is produced after the waste wind. The invention makes it easy to identify the yarn end after completion of the package. To this end, the yarn winds that are produced in a forward movement and a return movement between the package and the yarn reserve wind, are deposited with different slopes on the circumference of the tube. This is realized by carrying out the forward and the return movement of the yarn guide at different guiding speeds. The special advantage of this invention lies in that no waste yarn is included in the further processing operation.

In one embodiment of the method, the forward movement occurs in the transition of the yarn guide to the winding range before producing the waste wind, at a higher guiding speed than the return movement performed by the yarn guide after producing the waste wind. With that, the yarn end of the yarn reserve wind produced during the return movement, is deposited on the tube with a gentle slope, so that for forming the yarn end, it is possible to cut the yarn within the wind with a gentle slope.

However, it is also possible to perform the return movement of the yarn guide at a higher guiding speed than the forward movement. With that, the yarn end is to be formed with the yarn wind, which is deposited with a steeper slope between the yarn reserve and the package.

In the production of dye yarn packages, it is also common to wind a first yarn reserve wind before winding the waste wind. Such a first yarn reserve wind can be deposited inside or outside of the winding range. When winding outside of the winding range, it is preferred to wind the two yarn reserve winds in the same place on the tube circumference. This ensures that the second, relevant yarn reserve wind also exhibits a uniform dyeing as is required for further processing.

To secure the yarn end of a yarn reserve wind in an advantageous manner, the yarn guide may be operated at the beginning of the yarn reserve wind in a forward movement and a return movement directly following the forward movement. The forward movement occurs at a higher guiding speed than the return movement, so that the steep yarn wind deposited on the tube surface during the forward movement, is wound over by the winds following during the return movement. With that, it is realized that the yarn end is secured on the circumference of the tube by a plurality of side-by-side winds.

To secure the yarn end on the circumference of the tube with parallel winds, the distances covered by the yarn guide in its reciprocating movement may be different. Thus, a greater distance is covered in the forward movement than in the return movement, so that the winds deposited in the forward movement are covered by the winds produced in the return movement.

Another variant of the method is especially suited for securing the yarn with a minimal length of the yarn reserve wind. In this connection, the forward and return movements of the yarn guide occur briefly within a wind deposited on the tube, so that the deposited wind is directly wound over by a following wind.

The method of the present invention can be used with advantage in all known takeup devices. Thus, it is possible to transfer the yarn after a winding start from the yarn guide to a traversing yarn guide of a yarn traversing device, so that the yarn guide guides the yarn only during the catching and during the winding of the yarn reserve. However, it is also possible that the yarn guide guides the yarn during the catching, winding start, and winding, so that the yarn guide is simultaneously used a traversing yarn guide. Essential is that the movement of the yarn guide can be controlled by a controllable drive at a variable speed independently of the direction.

BRIEF DESCRIPTION OF THE DRAWINGS

In the following, the method is described in greater detail with reference to some embodiments and types of apparatus and to the attached drawings in which.

DETAILED OF THE PREFERRED EMBODIMENTS

Figure 1:
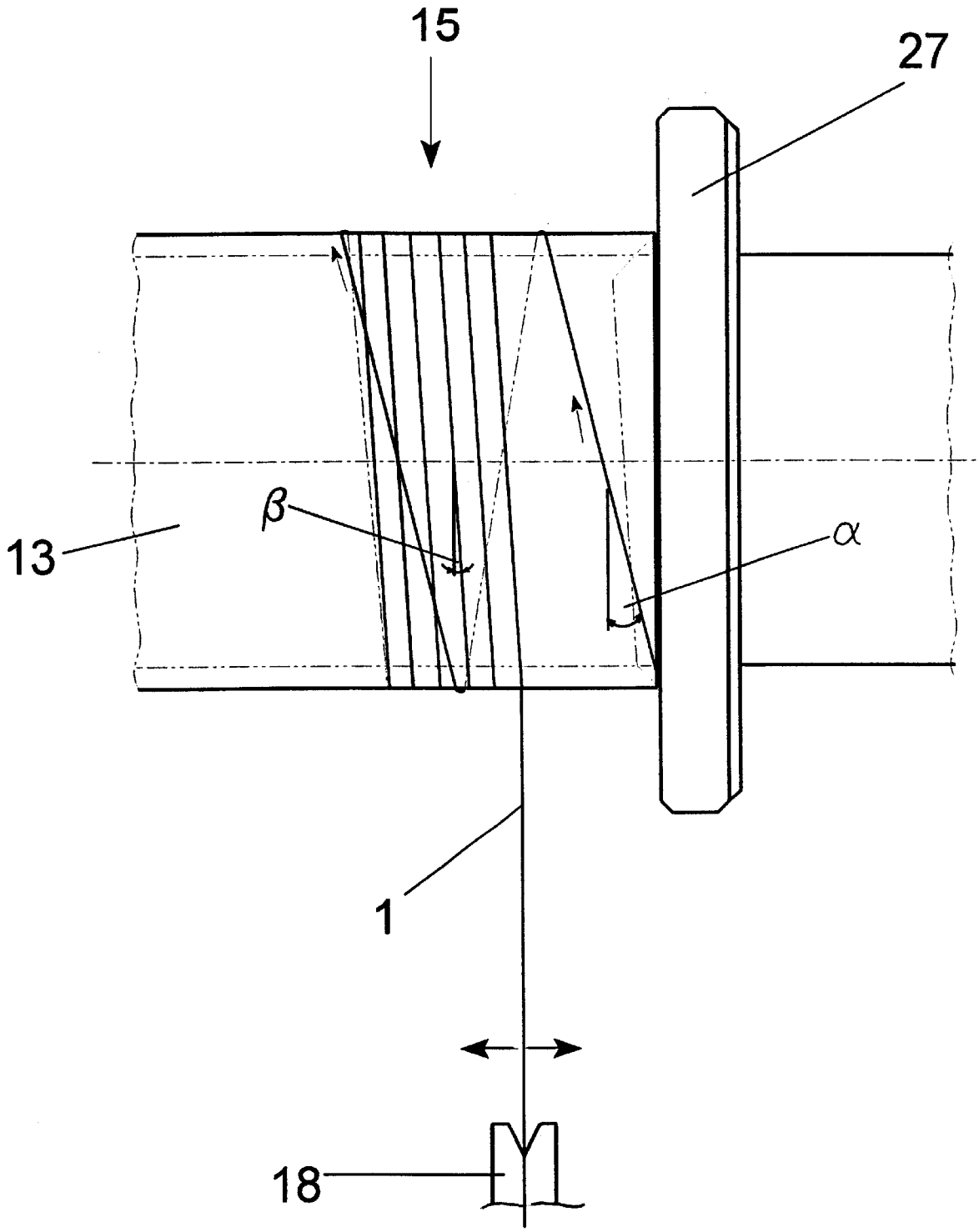
FIG. 1 is a schematic view of a clamped tube end with a first embodiment of a yarn reserve wind.

FIG. 1 schematically illustrates an end of a tube 13. The tube 13 is clamped between two centering plates and driven at a winding speed. FIG. 1 shows the right end of the tube 13 with the centering plate 27. In a plane substantially parallel to the tube 13, a movable yarn guide 18 is arranged. The yarn guide 18 connects to a drive, which is described in greater detail below. The yarn guide 18 guides a continuously advancing yarn 1.

To be able to wind the yarn 1 on the tube 13 to a package, it is necessary to catch the yarn 1 by means of a catching device. This threading operation proceeds in a known manner. To this end, the yarn guide 18 moves to a catching position at the end of the tube 13. In this phase, a suction device or a second, fully wound package continuously receives the advancing yarn 1. In the catching position of the yarn guide 18, the yarn 1 is guided over a catching device such that it is caught and cut. For example, in the case of the tube 13 shown in FIG. 1, catching could occur by a catching groove provided on the circumference of the centering plate 27. In so doing, the yarn is guided through the catching groove into a clamping slot between the front-face end of the tube 13 and the centering plate 27. After the yarn 1 is caught and cut, the yarn guide 18 moves in the direction of the package center for winding a yarn reserve wind. This forward movement is performed at a predetermined guiding speed of the yarn guide 18, so that the initial winds on the tube surface are deposited on the tube at an angle of slope $\alpha$. FIG. 1 shows two winds, which were deposited on the tube 13 during the forward movement. After a predetermined time or after a predetermined distance covered by the yarn guide 18, the forward movement ends, and the yarn guide moves back to the tube end in a return movement. In so doing, the return movement of the yarn proceeds at a lower guiding speed, so that the winds deposited on the tube 13 exhibits a smaller angle of slope $\beta$. The winds produced during the return movement are thus wound over the winds produced during the forward movement. With that, the yarn is secured on the circumference of the tube 13. After the yarn reserve wind 15 is fully wound, the yarn guide 18 moves to the winding range of the tube 13. The winding range is the area on the tube surface, in which the package is wound. Therefore, the winding range is defined by the package width. To wind the package, the yarn 1 can be guided by means of a separate, traversing yarn guide or by the yarn guide 18.

Figure 2:
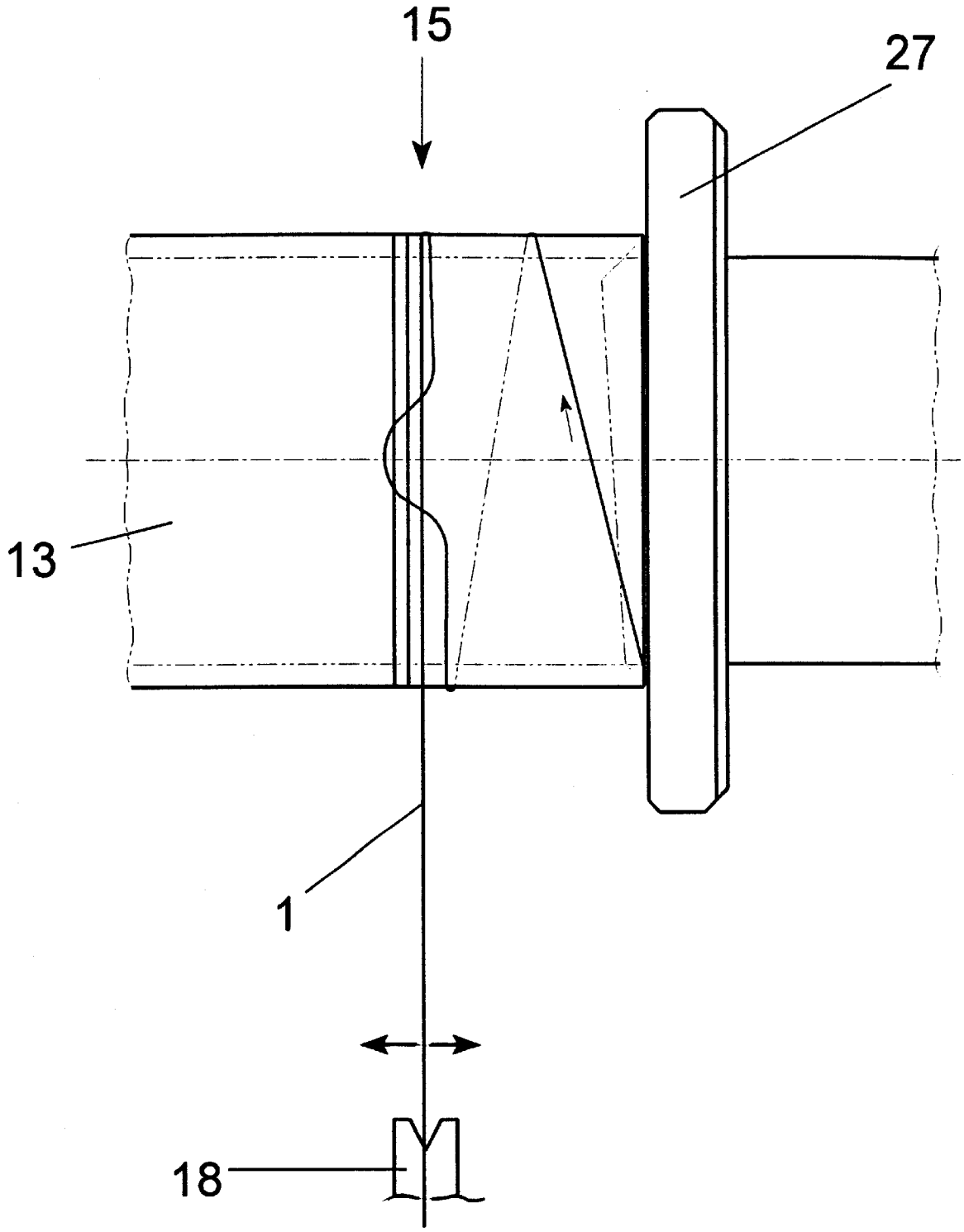
FIG. 2 is a schematic view of a clamped tube end with a further embodiment of a yarn reserve wind.

FIG. 2 shows a further embodiment of a yarn reserve wind. The apparatus parts are identical with the components shown in FIG. 1. Insofar the foregoing description is herewith incorporated by reference. After the yarn 1 is caught and clamped, the yarn guide 18 starts to move in a normal plane to the tube 13, in which the yarn reserve wind is to be produced. As soon as the yarn guide 18 reaches the normal plane, a brief forward and return movement of the traversing yarn guide 18 is generated, so that in a first wind, the yarn 1 is deposited on the tube 13 with a loop extending in the axial direction. Directly thereafter, the yarn reserve wind is produced, in that the loop of the first wind is wound over by the subsequent winds. After completing the yarn reserve wind 15 on the tube 13, the yarn guide 18 moves to the winding range. For producing the yarn reserve wind 15 in FIG. 1 and FIG. 2, it is preferred to move the yarn guide 18 in one direction at a constant guiding speed. However, for producing the yarn reserve wind 15, it is also possible to move the yarn guide 18 reciprocatingly with small deflections, so that a cross wind is produced.

Figure 3:
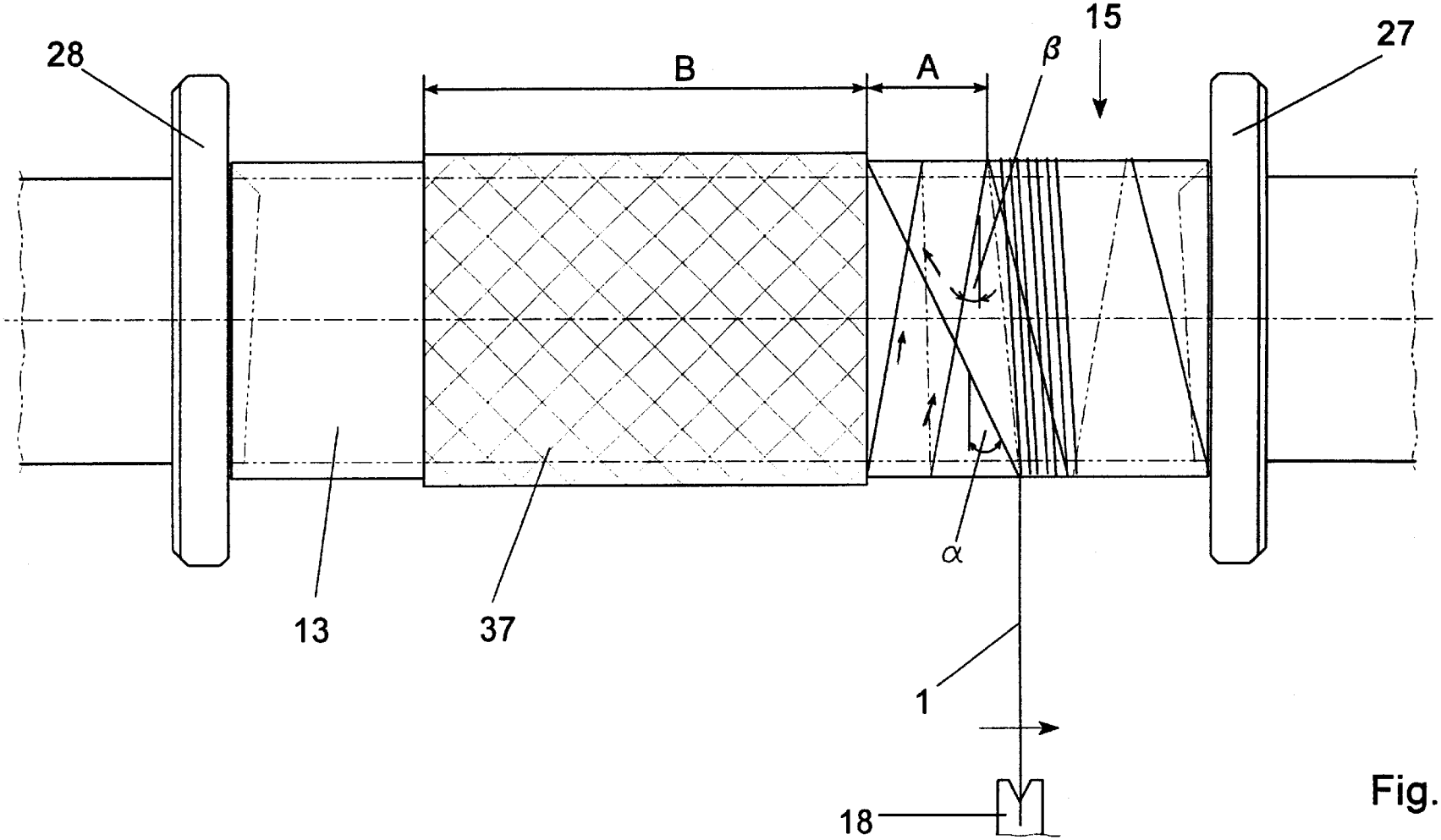
FIG. 3 is a schematic view of a clamped tube with a waste wind and yarn reserve winds.

FIG. 3 illustrates a further embodiment of a yarn reserve wind, which was produced by the method of the present invention. This method is applied in particular for producing packages, which are subjected to a dye treatment after the winding. Since in the dyeing of packages, the first yarn layers on the tube surface are not suitable for further processing because of dye differences, it is necessary to produce in the winding range a so-called waste wind. In the situation shown in FIG. 3, the tube 13 is clamped between centering plates 27 and 28. Once the yarn is threaded, the yarn guide 18 moves for producing a waste wind on the tube surface to the winding range, which is identified in FIG. 3 by the package width B. After completing the waste wind, a yarn reserve 15 is wound outside the winding range. Between the winding range B and the yarn reserve 15, a distance A extending in the axial direction is formed on the tube surface. In the region A, one or more transition winds by the deposit of yarn 1 are produced by the forward movement of the traversing yarn guide 18. At the transition to the waste wind 37, the forward movement of yarn guide 18 is performed at a predetermined guiding speed, so that a plurality of winds are deposited on the tube surface at an angle of slope $\alpha$.

Once the waste wind 37 is completed, the yarn guide 18 moves for producing the yarn reserve wind 15 from the winding range B toward the end of tube 13. In so doing, the return movement of yarn guide 18 occurs at a guiding speed, which differs from the guiding speed of the forward movement. The yarn 1 is deposited in the transition range A with winds, which exhibit an angle of slope $\beta$. In FIG. 3, the yarn guide 18 has covered the transition range A, and winds the yarn reserve wind 15. Once the yarn reserve wind 15 is completed, the yarn guide 18 returns, again in a forward movement, to the winding range B. In so doing, the forward movement occurs likewise at a guiding speed, which leads to a yarn deposit at an angle of slope α.

After completing the package, one needs to identify, based on the different angles of slope α and β in the transition range A, the yarn end, which is to be removed for joining to a subsequent package in a further processing operation. In the embodiment shown in FIG. 3, one would therefore cut the wind with the angle of slope β in the transition range A, and knot it as a trailing yarn end to a leading yarn end of a subsequent package. This ensures that the waste wind and, if need be, a first yarn reserve wind remain on the tube 13 and do no reach a further processing operation.

Figure 4:
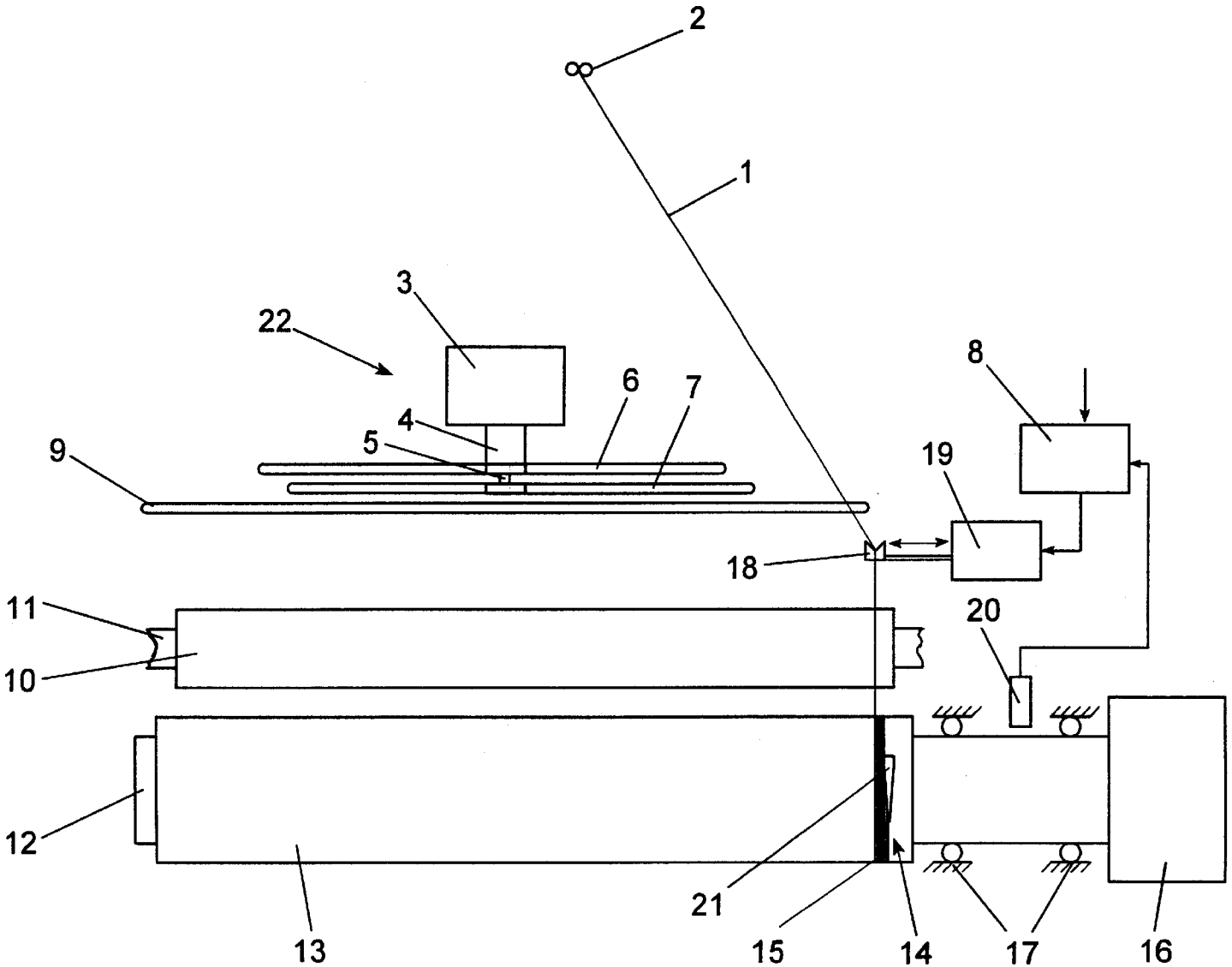
FIG. 4 is a schematic view of a first embodiment of an apparatus for carrying out the method.

FIG. 4 illustrates an embodiment of an apparatus, which is suitable for carrying out the method. The apparatus for winding an advancing yarn 1 comprises a winding spindle 12. The winding spindle 12 is supported in cantilever fashion with a bearing 17 in a machine frame. The bearing end of the winding spindle 12 connects to a spindle motor 16. The winding spindle 12 mounts a tube 13. A contact pressure roll 10 extends axis parallel to the winding spindle 12 in spaced relationship with the tube 13. The contact pressure roll 10 is rotatably supported with a shaft 11 in the machine frame. Upstream of the winding spindle 12 and contact pressure roll 10, a yarn traversing device 22 is arranged in the machine frame. In the present embodiment, the yarn traversing device 22 is of the rotary-blade type. A traversing yarn guide 7 designed and constructed as a rotary blade is rotated by means of a rotor 5 in such a manner that the yarn 1 is guided from the right package edge to the left package edge. In so doing, the yarn slides along a guide bar 9. At the opposite end, the yarn is taken over by a second rotary blade 6, which is driven by a rotor 4 in the opposite direction. For this purpose, the guide bar 9 is arranged between the yarn traversing device 22 and the contact pressure roll 10.

At its one end, the tube 13 mounted on winding spindle 12 comprises a catching device 14 which includes a catching groove 21. At the end of tube 13 with the catching device 14, a movable yarn guide 18 is arranged upstream of the winding spindle. The yarn guide 18 connects to a drive 19, which moves the yarn guide 18 in a plane parallel to the winding spindle 12 in the longitudinal direction of the tube 13 away from the tube end and back to the tube end. The drive 19 connects to a controller 8. In the region of the winding spindle 12, a sensor 20 is provided for measuring the rotational speed of the winding spindle. The sensor 20 connects to the controller. The controller 8 stores control programs for forming a yarn reserve wind 15.

FIG. 4 illustrates the operating situation, in which the yarn 1 continuously advancing via a yarn guide 2 reaches the takeup device and, while being guided by yarn guide 18, it contacts the tube 13. The yarn 1 is already caught in the catching device 14 and wound on the tube 13 to a yarn reserve wind. To this end, the yarn guide 18 is moved by drive 19. In this process, the drive 19 is controlled by controller 8.

After the yarn reserve wind is deposited on the tube 13, the yarn disengages from the yarn guide 18, and it drops into the traversing device. To this end, the yarn guide may be constructed for pivotal movement in the axial direction.

By determining the spindle speed, it is also possible to predetermine in the controller 8 the length of the yarn reserve wind from the parameters spindle speed and winding time of the yarn reserve wind.

Figure 5:
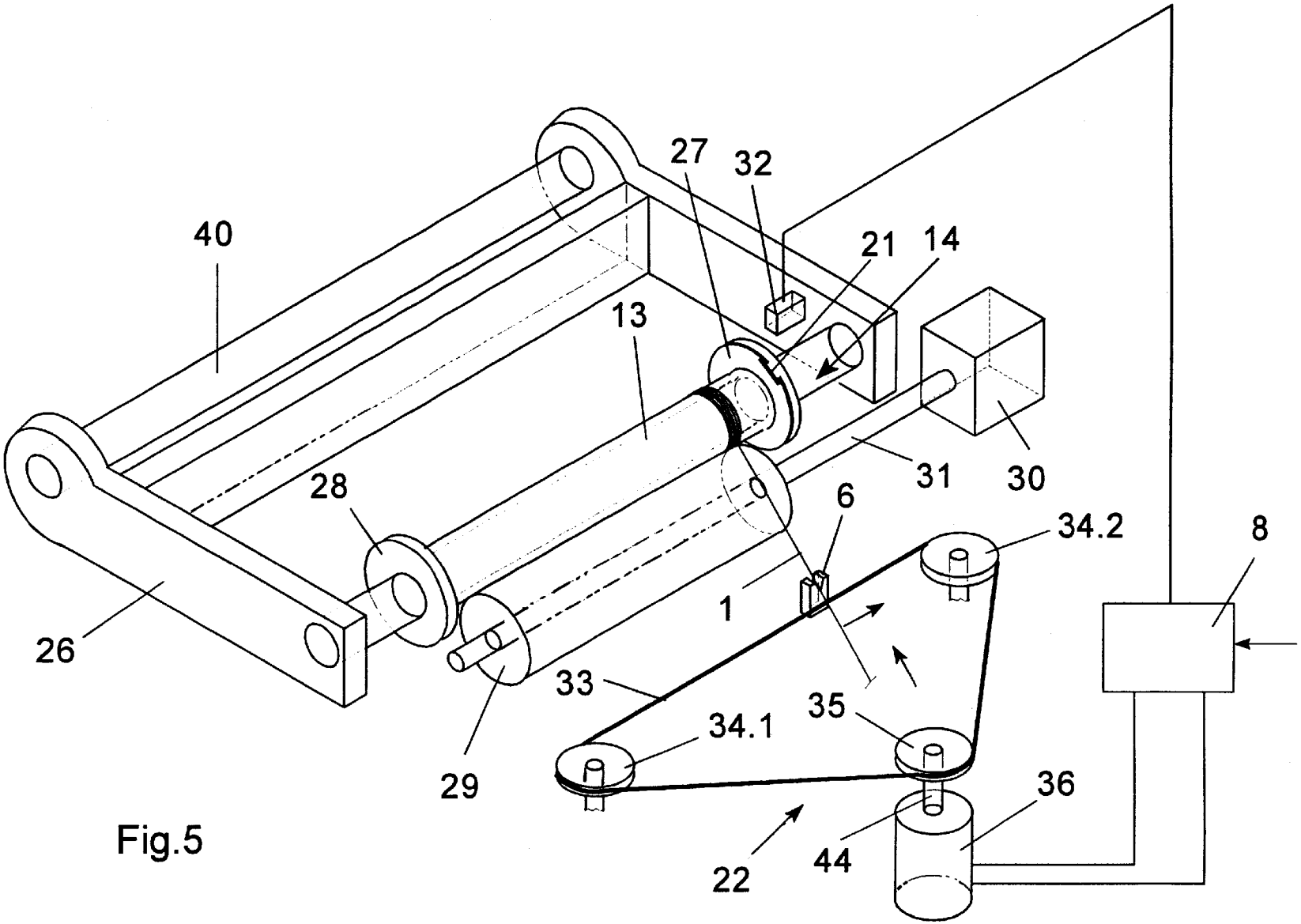
FIG. 5 is a schematic view of a further embodiment of an apparatus for carrying out the method.

FIG. 5 illustrates a further embodiment of an apparatus for carrying out the method, as is applied, for example in a texturing machine. In the following description, components with the same function are indicated at the same numerals. A pivot axle 40 arranged in a machine frame pivotally mounts a package holder 26. The free end of the fork-shaped package holder 26 rotatably supports two opposite centering plates 28 and 27. Between the centering plates 28 and 27, a tube 13 is clamped for receiving a package. A drive roll 29 lies against the surface of the tube 13. The drive roll 29 is mounted on a drive shaft 31. At its one end, the drive shaft 31 connects to a motor 30, which drives the drive roll 29 at a substantially constant speed. By frictional engagement, the drive drives the tube 13 to a winding speed, which makes it possible to wind the yarn at the yarn speed. The winding speed thus remains substantially constant during the winding cycle. Upstream of the drive roll 29, a yarn traversing device 22 is arranged. The yarn traversing device 22 is constructed as a so-called belt-type traversing device, in which a traversing yarn guide 6 is attached to an endless belt 33. The belt 33 extends between deflection pulleys 34.1 and 34.2 parallel to the tube 13. In the plane of the belt, a drive pulley 35 partially looped by the belt is arranged parallel to the deflection pulleys 34.1 and 34.2. The drive pulley 35 is mounted on a drive shaft 44 of an electric motor 36. The electric motor 36 drives the drive pulley 35 for oscillation, so that the traversing yarn guide 6 reciprocates in the range between the two deflection pulleys 34.1 and 34.2. The electric motor 36 is controllable via a controller 8. The controller 8 connects to a sensor 32 arranged on the package holder 26, which senses the rotational speed of centering plate 27.

In the apparatus shown in FIG. 5, the traversing yarn guide 6 guides the yarn for threading, catching, winding initial layers thereof, and for winding the package. The control programs for producing the yarn reserve wind and for winding the package respectively are stored in the controller 8, so that the motor 36 is able to control accordingly the traversing yarn guide 6 in the sequence of its movements. In the operating situation shown in FIG. 5, the yarn reserve wind 15 is just being wound.

That which is claimed:

1. A method of winding a continuously advancing yarn to a cross wound package within a winding range on a rotating tube, and comprising the steps of initially forming a yarn reserve on the tube outside of the winding range, by guiding the advancing yarn with a yarn guide which is moveable substantially parallel to the tube, and wherein the yarn guide is moved by a controllable drive such that the yarn guide is reciprocated to secure a trailing yarn end on the circumference of the tube with at least some of the winds of the yarn reserve, then winding the advancing yarn onto the tube within the winding range to form a cross wound package, and wherein the guiding step includes moving the yarn guide by the controllable drive such that the yarn guide is reciprocated in a forward direction toward the winding range and an opposite return direction, and so that the forward and return movements are at different speeds.

2. The method of claim 1 wherein the movement in the return direction directly follows the movement in the forward direction, and the forward movement is performed at a higher speed than the return movement.

3. The method of claim 1 wherein the distance covered by the yarn guide in its forward movement is greater than the distance covered by the yarn guide in its return movement.

4. The method of claim 1 wherein the forward movement and the return movement of the yarn guide occur briefly to form an axially extending loop within a wind deposited on the tube, so that the deposited wind can be wound over by a subsequent wind.

5. A method of winding a continuously advancing yarn to a cross wound package within a winding range on a rotating tube, and comprising the steps of initially forming a yarn reserve on the tube outside of the winding range, by guiding the advancing yarn with a yarn guide which is moveable substantially parallel to the tube, and wherein the yarn guide is moved by a controllable drive such that the yarn guide initially moves in a forward direction toward the winding range so as to form initial winds on the tube and then moves in a return direction to form further winds which overlie at least some of the initial winds and thereby secure the initial winds on the circumference of the tube, and such that the initial winds and the further winds lie outside of the winding range, and then winding the advancing yarn onto the tube within the winding range to form a cross wound package.

6. The method of claim 5 wherein the forward movement occurs at a speed which is different from the return movement speed.

7. The method of claim 5 wherein the forward movement occurs at a higher guiding speed than the return movement, so that a relatively steep yarn wind is formed during the forward movement and a less steep wind is formed during the return movement.

8. A method of winding a continuously advancing yarn to form a cross wound package within a winding range on a rotating tube, comprising the steps of guiding the advancing yarn onto the tube so that the yarn (1) initially moves in a forward direction at a predetermined speed from one end of the tube to the winding range, (2) then moves within the winding range to form a waste wind, (3) then moves in a rearward direction from the winding range toward the one end of the tube at a speed which differs from said predetermined speed and so as to form a yarn reserve outside the winding range, (4) then moves in the forward direction back into the winding range, and (5) then reciprocates within the winding range to form a cross wound package wherein the waste wind is formed along substantially the full length of the winding range.

9. The method as defined in claim 8 wherein the speed of the forward movement in step (4) is substantially the same as the predetermined speed of step (1).

10. The method as defined in claim 8 comprising the further subsequent step of cutting a winding formed during step (3) to form a free end which may be knotted to a leading yarn end of another package.

11. A method of winding a continuously advancing yarn to form a cross wound package within a winding range on a rotating tube, comprising the steps of guiding the advancing yarn onto the tube so that the yarn (1) initially moves in a forward direction from one end of the tube to the winding range, (2) then moves within the winding range to form a waste wind which extends along substantially the full length of the winding range, (3) then moves in a rearward direction from the winding range toward the one end of the tube so as to form a yarn reserve outside the winding range, (4) then moves in the forward direction back into the winding range, and (5) then reciprocates within the winding range to form a cross wound package.

12. The method as defined in claim 11 comprising the further subsequent step of cutting a winding formed during step (3) to form a free end which may be knotted to a leading yarn end of another package.

* * * * *

UNITED STATES PATENT AND TRADEMARK OFFICE

CERTIFICATE OF CORRECTION

PATENT NO. : 6,308,906 B1
DATED : October 30, 2001
INVENTOR(S) : Pyra et al.

It is certified that error appears in the above-identified patent and that said Letters Patent is hereby corrected as shown below:

Title page,
Item [56], References Cited, U.S. PATENT DOCUMENTS, insert the following:

| | | |
|---|---|---|
| -- 3,075,715 | 01/1963 | Hensen et al. |
| 4,093,135 | 06/1978 | Hermanns |
| 4,102,508 | 07/1978 | Stegelman |
| 4,195,788 | 04/1980 | Miyazaki et al. |
| 4,256,272 | 03/1981 | Reisser et al. |
| 5,511,734 | 04/1996 | Enger et al. |
| 5,603,464 | 02/1997 | Watabe et al. |
| 6,045,081 | 04/2000 | Oberstrass et al. |
| 6,189,826 | 02/2001 | Oberstrass --. |

Signed and Sealed this

Thirtieth Day of July, 2002

*Attest:*

*Attesting Officer*

JAMES E. ROGAN
*Director of the United States Patent and Trademark Office*